US010325706B2

(12) United States Patent
Kusawake et al.

(10) Patent No.: US 10,325,706 B2
(45) Date of Patent: Jun. 18, 2019

(54) COMPOSITE MATERIAL, MAGNETIC COMPONENT, AND REACTOR

(71) Applicants: AutoNetworks Technologies, Ltd., Yokkaichi-shi, Mie (JP); Sumitomo Wiring Systems, Ltd., Yokkaichi-shi, Mie (JP); Sumitomo Electric Industries, Ltd., Osaka-shi, Osaka (JP)

(72) Inventors: Kazushi Kusawake, Osaka (JP); Shigeki Masuda, Osaka (JP); Atsushi Sato, Osaka (JP)

(73) Assignees: AutoNetworks Technologies, Ltd., Yokkaichi-shi, Mie (JP); Sumitomo Wiring Systems, Ltd., Yokkaichi-shi, Mie (JP); Sumitomo Electric Industries, Ltd., Osaka-shi, Osaka (JP)

( * ) Notice: Subject to any disclaimer, the term of this patent is extended or adjusted under 35 U.S.C. 154(b) by 256 days.

(21) Appl. No.: 15/512,024

(22) PCT Filed: Aug. 28, 2015

(86) PCT No.: PCT/JP2015/074519

§ 371 (c)(1),
(2) Date: Mar. 16, 2017

(87) PCT Pub. No.: WO2016/043025

PCT Pub. Date: Mar. 24, 2016

(65) Prior Publication Data

US 2017/0263356 A1 Sep. 14, 2017

(30) Foreign Application Priority Data

Sep. 17, 2014 (JP) ..... 2014-189324

(51) Int. Cl.
*H01F 27/28* (2006.01)
*H01F 1/147* (2006.01)
(Continued)

(52) U.S. Cl.
CPC ..... *H01F 1/147* (2013.01); *H01F 1/26* (2013.01); *H01F 3/08* (2013.01); *H01F 27/24* (2013.01);
(Continued)

(58) Field of Classification Search
CPC ..... H01F 27/00–27/36
(Continued)

(56) References Cited

U.S. PATENT DOCUMENTS 2,791,561 A * 5/1957 Beller ..... H01F 1/20 148/104
9,847,156 B2 * 12/2017 Inaba ..... H01F 1/26
(Continued)

FOREIGN PATENT DOCUMENTS

CN 101814353 A 8/2010
JP 2000294418 A 10/2000
(Continued)

OTHER PUBLICATIONS

Office Action issued in Chinese Patent Application No. 201580050012.8 dated Jun. 4, 2018.
(Continued)

*Primary Examiner* — Tuyen Nguyen
(74) *Attorney, Agent, or Firm* — Honigman LLP

(57) ABSTRACT

Provided are a composite material having low iron loss, high saturation magnetization, and high strength, and a magnetic component and a reactor that include the composite material. A composite material contains a soft magnetic powder and a resin having the soft magnetic powder dispersed therein, the soft magnetic powder including a coarse powder having an average particle size $D_1$ of not less than 50 μm nor more than 500 μm and a fine powder having an average particle size $D_2$ of not less than 0.1 μm but less than 30 wherein the soft magnetic powder is contained in an amount of not less than 60 vol % nor more than 80 vol % with respect to the composite material as a whole.

18 Claims, 5 Drawing Sheets

(51) Int. Cl.

| | |
|---|---|
| ***H01F 1/26*** | (2006.01) |
| ***H01F 37/00*** | (2006.01) |
| ***H01F 27/24*** | (2006.01) |
| ***H01F 3/08*** | (2006.01) |
| ***H01F 27/255*** | (2006.01) |
| *H01F 3/10* | (2006.01) |

(52) U.S. Cl.
CPC ..... *H01F 27/255* (2013.01); *H01F 27/28* (2013.01); *H01F 37/00* (2013.01); *H01F 2003/106* (2013.01)

(58) Field of Classification Search
USPC ..... 336/65, 83, 212, 233–234
See application file for complete search history.

(56) References Cited

U.S. PATENT DOCUMENTS

2005/0076974 A1* 4/2005 Honkura ..... H01F 1/0572 148/104
2013/0286703 A1 10/2013 Inaba et al.
2013/0294129 A1* 11/2013 Inaba ..... H01F 1/26 363/131
2015/0248963 A1 9/2015 Inaba

FOREIGN PATENT DOCUMENTS

| | | | |
|---|---|---|---|
| JP | 2006-179621 | A | 7/2006 |
| JP | 2008192887 | A | 8/2008 |
| JP | 2010-153638 | A | 7/2010 |
| JP | 2012-212855 | A | 11/2012 |
| JP | 2012-212856 | A | 11/2012 |
| JP | 2014063923 | A | 4/2014 |
| WO | 2012/128034 | A1 | 9/2012 |
| WO | 2012/128037 | A1 | 9/2012 |
| WO | 2014/045673 | A1 | 3/2014 |

OTHER PUBLICATIONS

Search Report for International Application No. PCT/JP2015/074519, dated Nov. 2, 2015, 2 pages.
2nd Office Action, Chinese Patent Application No. 2015800500128, dated Mar. 4, 2019.

* cited by examiner

COMPOSITE MATERIAL, MAGNETIC COMPONENT, AND REACTOR

CROSS-REFERENCE TO RELATED APPLICATIONS

This application is the U.S. national stage of PCT/JP2015/074519, filed Aug. 28, 2015, which claims priority of Japanese Patent Application No. JP 2014-189324, filed Sep. 17, 2014.

TECHNICAL FIELD

The present invention relates to a composite material suited for a constituent member of a magnetic component such as a reactor, a magnetic component including the composite material, and a reactor, which is a magnetic component, and more particularly to a composite material having low iron loss, high saturation magnetization, and high strength.

BACKGROUND ART

Magnetic components are used as components of various products such as automobiles, electrical equipment, and industrial machinery. A magnetic component includes a coil formed by winding a wire and a magnetic core on which the coil is disposed. Specific examples of the magnetic component include reactors, choke coils, transformers, motors, and the like.

For example, in reactors disclosed in JP 2012-212855A and JP 2012-212856A, a respective composite material manufactured by filling a mixture of a magnetic powder and a resin into a shaping mold and solidifying (hardening) the resin is used as at least a portion of the above-described magnetic core. The magnetic powder of the composite material disclosed in JP 2012-212855A has a plurality of particles composed of the same material and has a plurality of peaks in its particle size distribution. On the other hand, the magnetic powder of the composite material disclosed in JP 2012-212856A has particles of a plurality of materials having different relative permeabilities and has a plurality of peaks in its particle size distribution. In this manner, a low-loss and high-saturation-magnetization reactor is created by using a composite material having a magnetic powder that is composed of the same type of material or different types of materials and that has a plurality of peaks.

SUMMARY OF INVENTION

As interest in recent energy problems increases, requirements on properties of the composite material also become more demanding, and it is thus desired to develop a composite material having lower iron loss and higher strength. As described above, the composite materials in Patent Documents 1 and 2 can ensure certain levels of low iron loss and high saturation magnetization. However, there is room for further improvement in achieving both enhancement of the magnetic properties such as low iron loss and high saturation magnetization and enhancement of the strength.

In view of the above-described circumstances, the present invention provides a composite material having low iron loss, high saturation magnetization, and high strength.

Also, the present invention provides a magnetic component and a reactor that include the above-described composite material.

A composite material according to an aspect of the present invention is a composite material that has a soft magnetic powder and a resin having the soft magnetic powder dispersed therein. The soft magnetic powder includes a coarse powder having an average particle size $D_1$ of not less than 50 μm nor more than 500 μm and a fine powder having an average particle size $D_2$ of not less than 0.1 μm but less than 30 μm. The soft magnetic powder is contained in an amount of not less than 60 vol % nor more than 80 vol % with respect to the composite material as a whole.

The above-described composite material has low iron loss, high saturation magnetization, and high strength.

DETAILED DESCRIPTION OF THE PREFERRED EMBODIMENTS

Figure 1:
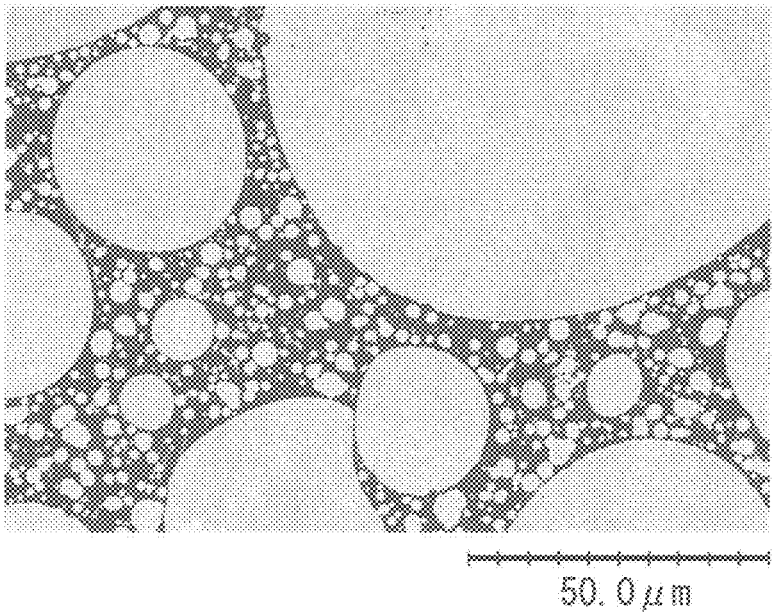
FIG. 1 is a micrograph of Sample No. 1-2.

The inventors of the present invention have conducted intensive investigations in order to achieve both enhancement of the magnetic properties and enhancement of the strength. As a result, it was found that a composite material having low iron loss, high saturation magnetization, and high strength can be obtained by the composite material containing a fine powder having an even smaller average particle size than conventional fine powders. The present invention is based on this finding. First, the details of aspects of the present invention will be listed and described.

(1) A composite material according to an aspect of the present invention is a composite material that has a soft magnetic powder and a resin having the soft magnetic powder dispersed therein. The soft magnetic powder includes a coarse powder having an average particle size $D_1$ of not less than 50 μm nor more than 500 μm and a fine powder having an average particle size $D_2$ of not less than 0.1 μm but less than 30 μm. The soft magnetic powder is contained in an amount of not less than 60 vol % nor more than 80 vol % with respect to the composite material as a whole.

With the above-described configuration, the composite material in which the soft magnetic powder including the coarse powder and the fine powder having the above-described respective average particle sizes is contained in an amount (filling ratio) within the above-described range has low iron loss, high saturation magnetization, and high strength.

When the average particle size $D_1$ of the coarse powder is not less than 50 μm, the difference in particle size between the coarse powder and the fine powder is sufficiently large, and thus the fine powder can be disposed between the coarse powder particles. Therefore, the filling ratio can be increased, and also the hysteresis loss can be reduced. When the average particle size $D_1$ is not more than 500 μm, the coarse particles are not excessively large. Therefore, the eddy-current loss of the coarse powder itself can be reduced, and hence the eddy-current loss of the composite material can be reduced. In addition to this, the filling ratio can be increased, so that the saturation magnetization of the composite material can be increased.

When the average particle size $D_2$ of the fine powder satisfies the above-described range, the fine powder is sufficiently smaller than the coarse powder, and thus the eddy-current loss of the fine powder itself is small. Furthermore, changes in the relative permeability are small up to a high magnetic field (e.g., 25000 A/m). In addition, the soft magnetic powder content with respect to the composite material as a whole is easily increased to 60 vol % or more. Moreover, when the average particle size $D_2$ of the fine powder is not less than 0.1 μm, aggregation of the fine powder particles is easily suppressed, and also a decrease in the fluidity of the mixture serving as the raw material due to the resistance caused by contact between the fine powder and the resin is easily suppressed. When the average particle size $D_2$ is less than 30 μm, contact between the coarse powder particles can be suppressed, and thus the eddy-current loss is easily reduced. Moreover, the filling ratio is easily increased, and thus the saturation magnetization is easily increased.

When the above-described soft magnetic powder content is not less than 60 vol %, the proportion of magnetic ingredients is sufficiently high, so that the saturation magnetization can be increased. When the above-described soft magnetic powder content is not more than 80 vol %, the mixture in which the soft magnetic powder is kneaded with the resin in a molten state or the mixture in which the soft magnetic powder is mixed with the resin in a liquid state, the mixture serving as the raw material, has excellent fluidity during manufacturing of the composite material. Thus, during shaping of the mixture, the mixture is easily filled into a desired shaping mold, and therefore the ease of manufacturing the composite material is excellent.

Although the reason that the above-described composite material has high strength is not clear, the following reasons are conceivable.

(a) When the average particle size $D_2$ satisfies the above-described range, the average particle size $D_2$ is sufficiently smaller than the average particle size $D_1$, and thus the fine powder can be uniformly dispersed between the coarse powder particles. Therefore, the residual strain that will occur in the resin due to shrinkage of the resin when the resin solidifies can be reduced.

(b) Since the fine powder can be uniformly dispersed between the coarse powder particles, contact between the coarse powder particles due to shrinkage of the resin during solidification can be suppressed. That is to say, the resin can be disposed between the coarse powder particles.

(2) As an embodiment of the above-described composite material, the fine powder may be contained in an amount of not less than 5 vol % but less than 40 vol % with respect to the soft magnetic powder as a whole.

With the above-described configuration, when the above-described fine powder content is not less than 5 vol %, the filling ratio can be increased, and thus the saturation magnetization can be increased. When the above-described fine powder content is less than 40 vol %, the above-described fine powder content is not excessively large, and thus the fluidity of the mixture can be increased, and the ease of manufacturing the composite material is excellent.

(3) As an embodiment of the above-described composite material, the coarse powder may be contained in an amount of more than 60 vol % but not more than 95 vol % with respect to the soft magnetic powder as a whole.

When the above-described coarse powder content is more than 60 vol %, the above-described fine powder content is not excessively large. Thus, the mixture has excellent fluidity, and therefore the ease of manufacturing the composite material is excellent. When the above-described coarse powder content is not more than 95 vol %, the fine powder can be disposed between the coarse powder particles, so that contact between the coarse powder particles can be suppressed, and the eddy-current loss can be reduced. In addition, the filling ratio can be increased, and thus the saturation magnetization can be increased.

(4) As an embodiment of the above-described composite material, one of the coarse powder and the fine powder may be an Fe-base alloy, and the other of the coarse powder and the fine powder may be Fe.

With the above-described configuration, since the Fe-base alloy has high electric resistance and it is easy to reduce the eddy-current loss as compared with Fe, and Fe has high saturation magnetization as compared with the Fe-base alloy, a good balance between iron loss and saturation magnetization is achieved.

(5) As an embodiment of the above-described composite material, when one of the coarse powder and the fine powder is an Fe-base alloy, and the other of the coarse powder and the fine powder is Fe, the fine powder may be Fe.

With the above-described configuration, the fine powder is Fe, and the coarse powder is the Fe-base alloy. With this configuration, the iron loss is lower than that in the case where the fine powder is the Fe-base alloy, and the coarse powder is Fe.

(6) As an embodiment of the above-described composite material, the soft magnetic powder may have a plurality of peaks in its particle size distribution, and at least two peaks of these peaks may be peaks of the coarse powder and the fine powder.

With the above-described configuration, the proportions of the coarse powder and the fine powder in the soft magnetic powder are large, and it is thus possible to reduce the eddy-current loss, enhance the saturation magnetization, and enhance the strength as described above.

(7) As an embodiment of the above-described composite material, a ratio $D_2/D_1$ of the average particle size $D_2$ of the fine powder to the average particle size $D_1$ of the coarse powder may be not more than ⅓.

With the above-described configuration, when the above-described ratio $D_2/D_1$ is not more than ⅓, the fine powder can be uniformly dispersed between the coarse powder particles, and it is thus possible to effectively reduce the eddy-current loss, enhance the saturation magnetization, and enhance the strength.

(8) As an embodiment of the above-described composite material, the resin may be a thermoplastic resin.

With the above-described configuration, when the resin is a thermoplastic resin, even when the mixture includes the fine powder that has an even smaller average particle size than conventional fine powders, the mixture has excellent fluidity. Therefore, during shaping of the mixture, the mixture is easily filled into a desired shaping mold, and thus the ease of manufacturing the composite material is excellent. Moreover, during manufacturing of the composite material, shaping can be performed under pressure, and also the melt viscosity of the resin is easy to adjust. Thus, filling is easily performed.

(9) A magnetic component according to an aspect of the present invention includes a coil formed by winding a wire and a magnetic core on which the coil is disposed. At least a portion of the magnetic core is composed of the composite material according to any one of the sections (1) to (8) above.

The above-described magnetic component has low loss, high saturation magnetization, and high strength.

(10) A reactor according to an aspect of the present invention includes a coil formed by winding a wire and a magnetic core on which the coil is disposed. At least a portion of the magnetic core is composed of the composite material according to any one of the sections (1) to (8) above.

The above-described reactor includes the composite material that has low loss, high saturation magnetization, and high strength. Thus, the reactor has excellent magnetic properties, and also is highly reliable with the magnetic core having high strength.

Details of Embodiments of the Present Invention

Specific examples of a composite material, a magnetic component (a reactor and a choke coil by way of example), a converter, and a power conversion device according to embodiments of the present invention will be described below with appropriate reference to the drawings. It should be noted that the present invention is not limited to these examples and is defined by the claims, and all changes which come within the meaning and range of equivalency of the claims are intended to be embraced therein.

Composite Material

A composite material according to an embodiment contains a soft magnetic powder and a resin having the soft magnetic powder dispersed therein. The composite material is obtained by solidifying (hardening) a mixture in which the soft magnetic powder and the resin in a molten state are kneaded together or a mixture in which the soft magnetic powder and the resin in a liquid state are mixed together. The composite material typically constitutes at least a portion of a magnetic core included in a magnetic component (a reactor, a choke coil, or the like), which will be described later. The primary feature of the composite material is that a soft magnetic powder including two types of powders, coarse and fine, having respective specific sizes is contained in a specific amount with respect to the composite material as a whole. Although details will be described later, this makes it possible to achieve both enhancement of the magnetic properties such as low iron loss and high saturation magnetization and enhancement of the strength. Hereinafter, details of the composite material will be described.

Soft Magnetic Powder

The soft magnetic powder includes the coarse powder and the fine powder that have different average particle sizes. The soft magnetic powder (the total of the coarse powder and the fine powder) may be contained in an amount of not less than 60 vol % nor more than 80 vol % with respect to the composite material as a whole. When the above-described soft magnetic powder content is not less than 60 vol %, the proportion of magnetic ingredients is sufficiently high, and thus the saturation magnetization can be increased. When the above-described soft magnetic powder content is not more than 80 vol %, the amount of soft magnetic powder is not excessively large, and the resin can be disposed between the soft magnetic powder particles, so that eddy-current loss can be reduced. Also, since the amount of soft magnetic powder is not excessively large, the mixture of the soft magnetic powder and the resin, the mixture serving as the raw material, has excellent fluidity. Therefore, during shaping of the mixture, the mixture is easily filled into a predetermined shaping mold, and thus the ease of manufacturing the composite material is excellent. More preferably, the above-described soft magnetic powder content is not less than 65 vol % nor more than 75 vol %.

Coarse-Particle Powder

The coarse powder may have an average particle size $D_1$ of not less than 50 μm nor more than 500 μm. When the average particle size $D_1$ is not less than 50 μm, the difference in particle size between the coarse powder and the fine powder is sufficiently large, and thus the fine powder can be disposed between the coarse powder particles. Therefore, the filling ratio can be increased, and the eddy-current loss can be reduced. When the average particle size $D_1$ is not more than 500 μm, the coarse particles are not excessively large. Thus, the eddy-current loss of the coarse powder itself can be reduced, and hence the eddy-current loss of the composite material can be reduced. In addition, the filling ratio can be increased, and the saturation magnetization of the composite material can be increased. The average particle size $D_1$ is preferably not less than 50 μm nor more than 300 μm, and more preferably not less than 50 μm nor more than 100 μm.

The coarse powder is contained in an amount of preferably more than 60 vol % but not more than 95 vol % with respect to the soft magnetic powder as a whole. When the above-described coarse powder content is more than 60 vol %, the fine powder content with respect to the soft magnetic powder as a whole is not excessively large. Thus, the fluidity of the mixture can be increased, and therefore the ease of manufacturing the composite material is excellent. On the other hand, when the above-described coarse powder content is not more than 95 vol %, the above-described coarse powder content is not excessively large, and the fine powder content with respect to the soft magnetic powder as a whole can be increased, so that the fine powder can be disposed between the coarse powder particles. Therefore, contact between the coarse powder particles can be suppressed, and the eddy-current loss can be reduced. In addition, the filling ratio can be increased, and the saturation magnetization can be increased. Moreover, it is considered that since the fine powder can be disposed between the coarse powder particles, the residual strain that will occur in the resin due to shrinkage of the resin when the resin solidifies during manufacturing of the composite material can be reduced. Moreover, contact between the coarse powder particles due to shrinkage of the resin during solidification can be suppressed. It is considered that the strength of the composite material can thus be increased, although the specific reason is not clear. The above-described coarse powder content is more preferably not less than 65 vol % nor more than 90 vol %, and even more preferably not less than 70 vol % nor more than 85 vol %.

Fine-Particle Powder

The fine powder may have an average particle size $D_2$ of not less than 0.1 μm but less than 30 μm. When the average particle size $D_2$ satisfies this range, the average particle size of the fine powder is sufficiently smaller than that of the coarse powder, and thus the eddy-current loss is small. Furthermore, changes in the relative permeability are small up to a high magnetic field (e.g., 25000 A/m). In addition, the soft magnetic powder content with respect to the composite material as a whole is easily increased to 60 vol % or more. Moreover, when the average particle size $D_2$ is not less than 0.1 μm, aggregation of the fine powder particles is easily suppressed, and a decrease in the fluidity of the mixture serving as the raw material due to resistance caused by contact between the fine powder and the resin is easily suppressed. On the other hand, when the average particle size $D_2$ is less than 30 μm, contact between the coarse powder particles can be suppressed, and thus the eddy-current loss is easily reduced. Also, the filling ratio is easily increased, and thus the saturation magnetization is easily increased. The average particle size $D_2$ is preferably not less than 0.5 μm nor more than 20 μm, and more preferably not less than 1.0 μm nor more than 10 μm.

The fine powder is contained in an amount of preferably not less than 5 vol % but less than 40 vol % with respect to the soft magnetic powder as a whole. When the above-described fine powder content is not less than 5 vol %, the fine powder can be disposed between the coarse powder particles, so that contact between the coarse powder particles can be suppressed, and the eddy-current loss can be suppressed. In addition, the filling ratio can be increased, and the saturation magnetization can be increased. When the above-described fine powder content is less than 40 vol %, the above-described fine powder content is not excessively large. Thus, the mixture has excellent fluidity, and therefore the ease of manufacturing the composite material is excellent. The above-described fine powder content is more preferably not less than 10 vol % 35 vol %, and even more preferably not less than 15 vol % nor more than 30 vol %.

Particle Size Distribution of Soft Magnetic Powder (Coarse and Fine)

The soft magnetic powder has a plurality of peaks (high frequency values) in its particle size distribution. The presence of a plurality of peaks in the particle size distribution means that, in a histogram of the particle size distribution, the peaks are present at a point of a small particle size and a point of a large particle size. At least two of the plurality of peaks may be a peak of the coarse powder and a peak of the fine powder, that is, the above-described average particle sizes $D_1$ and $D_2$. When the soft magnetic powder has a peak of the coarse powder and a peak of the fine powder, it is possible to reduce the eddy-current loss, enhance the saturation magnetization, and enhance the strength as described above.

The difference in average particle size between the coarse powder and the fine powder may be large. This makes it possible for the fine powder to be uniformly dispersed between the coarse powder particles, and it may thus be possible to effectively reduce the eddy-current loss, enhance the saturation magnetization, and enhance the strength. For example, the ratio $D_2/D_1$ of the average particle size $D_2$ of the fine powder to the average particle size $D_1$ of the coarse powder can be set to be not more than ⅓. The ratio $D_2/D_1$ can be set to be not more than 1/10, and furthermore, not more than 1/20. The ratio $D_2/D_1$ may be not less than about 1/150. When the ratio $D_2/D_1$ is not less than 1/150, the fine powder is not excessively smaller than the coarse powder and can function as a spacer that keeps a distance between the coarse powder particles while being disposed between the coarse powder particles. Preferably, the ratio $D_2/D_1$ is not less than 1/40.

Material for Soft Magnetic Powder (Coarse and Fine)

Soft magnetic materials such as iron group metals, Fe-base alloys composed mainly of Fe, ferrite, and amorphous metals can be used as the materials for the soft magnetic powder (coarse and fine). Among these, iron group metals and Fe-base alloys are preferable in terms of eddy-current loss and saturation magnetization. The iron group metals include Fe, Co, and Ni. In particular, it is preferable if Fe is pure iron (containing unavoidable impurities). Since Fe has high saturation magnetization, the higher the Fe content, the more the saturation magnetization of the composite material can be increased. The Fe-base alloys may contain, as an additional element, at least one element selected from Si, Ni, Al, Co, and Cr in a total amount of not less than 1.0 mass % nor more than 20.0 mass %, with the remainder having a composition including Fe and unavoidable impurities. Examples of the Fe-base alloys include Fe—Si based alloys, Fe—Ni based alloys, Fe—Al based alloys, Fe—Co based alloys, Fe—Cr based alloys, Fe—Si—Al based alloys (Sendust), and the like. In particular, Si-containing Fe-base alloys such as Fe—Si based alloys and Fe—Si—Al based alloys have high electrical resistivity, thereby facilitating the reduction of the eddy-current loss, and also have small hysteresis loss, thereby making it possible to lower the iron loss of the composite material. For example, when an Fe—Si based alloy is used, the Si content may be not less than 1.0 mass % nor more than 8.0 mass %, and is preferably not less than 3.0 mass % nor more than 7.0 mass %.

Relationship Between Materials for Coarse and Fine Powders

Although the coarse powder and the fine powder may be made of the same type of material, such as Fe or an Fe-base alloy, the coarse powder and the fine powder are preferably made of different types of materials as in the case where, for example, one of the coarse powder and the fine powder is made of Fe and the other is made of an Fe-base alloy. When different types of materials are used as the materials for the two types of powders as described above, the properties of Fe (high saturation magnetization) and the properties of the Fe-base alloy (high electrical resistance, which facilitates the reduction of the eddy-current loss) can be combined together, thereby achieving a good balance between the effect of enhancing saturation magnetization and the iron loss. When different types of materials are used as the materials for the two types of powders, either of the coarse powder and the fine powder may be made of Fe (Fe-base alloy), but it is preferable that the fine powder is made of Fe. That is to say, it is preferable that the coarse powder is made of the Fe-base alloy. In that case, the iron loss is lower than in the case where the fine powder is made of the Fe-base alloy, and the coarse powder is made of Fe.

Resin

The resin retains the soft magnetic powder, and also is disposed between the soft magnetic powder particles, thereby suppressing contact between the soft magnetic powder particles. The resin may be contained in an amount of not less than 20 vol % nor more than 40 vol % with respect to the composite material as a whole. When the above-described resin content is not less than 20 vol %, the soft magnetic powder can be firmly retained, and the resin is easily disposed between the soft magnetic powder particles. When the above-described resin content is not more than 40 vol %, the above-described resin content is not excessively large, and the above-described soft magnetic powder content can be increased. Preferably, the above-described resin content is not less than 25 vol % nor more than 35 vol %.

For example, thermosetting resins such as epoxy resins, phenolic resins, silicone resins, and urethane resins, and thermoplastic resins such as polyphenylene sulfide (PPS) resins, polyamide resins (e.g., nylon 6, nylon 66, nylon 9T, and nylon 10T), liquid crystal polymers (LCPs), polyimide resins, and fluororesins can be used as the resin. In addition to these resins, cold-setting resins, low-temperature setting resins, BMCs (Bulk molding compounds) in which calcium carbonate and glass fiber are mixed with unsaturated polyester, millable silicone rubber, millable urethane rubber, and the like can also be used. In particular, thermoplastic resins are preferable as the resin.

Others

In addition to the soft magnetic powder and the resin, the composite material may also contain a non-magnetic powder (filler) made of ceramics such as alumina or silica. The filler contributes to enhancement of heat dissipation properties and suppression of uneven distribution (uniform dispersion) of the soft magnetic powder. Moreover, when the filler is constituted by fine particles and disposed between the soft magnetic particles, a decrease in the proportion of the soft magnetic powder that will be caused by the composite material containing the filler can be suppressed. The filler content is preferably not less than 0.2 mass % nor more than 20 mass %, more preferably not less than 0.3 mass % nor more than 15 mass %, and particularly preferably not less than 0.5 mass % nor more than 10 mass % with respect to 100 mass % of the composite material.

Measurement of Various Parameters

Various parameters of the above-described composite material are measured by observing a cross section of the composite material using a scanning electron microscope (SEM). The cross section of the composite material can be obtained by cutting the composite material using an appropriate cutting tool, and then polishing the cut composite material. The obtained cross section is observed under the SEM to acquire an observation image. Here, it is assumed that the magnification of the SEM is not less than 200 nor more than 500, the number of cross sections to be observed (number of observation images to be acquired) is not less than 10 (one field of view per screen), and the total cross-sectional area is not less than 0.1 $cm^2$. The acquired observation images are each subjected to image processing (e.g., binarization processing) to extract the contours of particles.

Measurement of Soft Magnetic Powder Content

The soft magnetic powder content (vol %) with respect to the composite material as a whole is regarded as being equivalent to the proportion of the area of the soft magnetic powder in the cross section of the composite material. The proportion of the area of the soft magnetic powder in the cross section of the composite material as used herein means a value that is obtained by calculating the proportion of the area of the soft magnetic particles in each of the observation images and averaging the calculated proportions. That is to say, the obtained average value is regarded as the soft magnetic powder content (vol %) with respect to the composite material as a whole.

Measurement of Average Particle Sizes $D_1$•$D_2$

The average particle size $D_1$ of the coarse powder and the average particle size $D_2$ of the fine powder are each obtained in the following manner. In each of the observation images, the particle size distribution of all the particles whose contours have been extracted is obtained. A peak that is located on the coarsest particle side in the particle size distribution is obtained for each observation image, the obtained peaks are averaged, and the average value is used as the average particle size $D_1$ of the coarse powder. Similarly, a peak that is located on the finest particle side in the particle size distribution is obtained for each observation image, the obtained peaks are averaged, and the average value is used as the average particle size $D_2$ of the fine powder.

Measurement of Coarse Powder Content•Fine Powder Content

The coarse powder content (vol %) with respect to the soft magnetic powder as a whole and the fine powder content (vol %) with respect to the soft magnetic powder as a whole are regarded as being equivalent to the proportion of the area of the coarse powder in the cross section of the composite material and the proportion of the area of the fine powder in the cross section of the composite material, respectively. The proportion of the area of the coarse powder in the cross section of the composite material is obtained by calculating the proportion of the area of the coarse powder in each observation image using a formula $\{(S_L/S)\times 100\}$, where S represents the total cross-sectional area of each observation image, and $S_L$ represents the total cross-sectional area of the coarse powder in each observation image, and averaging the calculated proportions of the area of the coarse powder in the respective observation images. Similarly, the proportion of the area of the fine powder in the cross section of the composite material is an average value of the proportions of the area of the fine powder in the respective observation images that are calculated using a formula $\{(S_S/S)\times 100\}$, where $S_S$ represents the total cross-sectional area of the fine powder in each observation image. In each observation image, the coarse powder and the fine powder can be distinguished from each other based on the difference in contrast and the difference in particle shape. For example, pure iron appears darker than an Fe-base alloy (an Fe-base alloy appears brighter than pure iron). In particular, when determination is performed based on both the difference in contrast and the difference in particle shape, the coarse powder and the fine powder are easily distinguished from each other.

Analysis of Ingredients of Soft Magnetic Powder

Ingredients of the materials for the soft magnetic powder can be analyzed using X-ray diffraction, energy-dispersive X-ray spectroscopy: EDX, or the like.

Manufacturing Method

The composite material can typically be manufactured by injection molding or cast molding. Injection molding is performed by supplying the mixture to an injection molding device, plasticizing and injecting (filling) the mixture into a mold, and then solidifying (hardening) the mixture through cooling. Cast molding is performed by filling the mixture into a shaping mold while applying pressure if necessary, and solidifying (hardening) the mixture through heating. The particle sizes and the content of the soft magnetic powder (coarse and fine) used in the raw material remain substantially unchanged before and after manufacturing the composite material, and therefore, the particle size distribution and the content of the composite material (coarse and fine) are substantially the same as the particle size distribution and the content of the soft magnetic powder used in the raw material. However, since the raw material and the resulting composite material are not measured using the same method, the measurement results may vary to some extent. For this reason, if measured values of the soft magnetic powder content with respect to the composite material, the average particle sizes of the soft magnetic powder (coarse and fine), and the coarse powder content and the fine powder content with respect to the soft magnetic powder of the the composite material, the values being measured in the above-described manner, fall within ranges of ±5% of the soft magnetic powder content with respect to the mixture used as the raw material, the average particle sizes of the coarse and the fine powders, and the coarse powder content and the fine powder content with respect to the soft magnetic powder of the raw material, the particle size distribution and the content of the composite material are regarded as being substantially the same as the particle size distribution and the content of the soft magnetic powder used as the raw material.

Effects

The above-described composite material has the following effects. Since the composite material contains the coarse powder and the fine powder that have respective specific average particle sizes, the fine powder can be disposed between the coarse powder particles, and contact between the coarse powder particles can be suppressed. Therefore, the eddy-current loss can be reduced. Moreover, since the fine powder can be disposed between the coarse powder particles, the soft magnetic powder content with respect to the composite material as a whole can be increased, and therefore the saturation magnetization can be improved. Furthermore, the fine powder can be uniformly dispersed between the coarse powder particles by making the average particle size of the fine powder, which is disposed between the coarse powder particles, extremely small. Therefore, the residual strain that will occur in the resin due to shrinkage of the resin when the resin solidifies can be reduced. In addition, contact between the coarse powder particles due to shrinkage of the resin during solidification can be suppressed. That is to say, the resin can be disposed between the coarse powder particles.

Test Examples

Composite materials each containing a soft magnetic powder and a resin were produced, and the magnetic properties and the strength of the composite materials were evaluated.

Sample Nos. 1-1 to 1-3

Composite materials of Sample Nos. 1-1 to 1-3 were produced by using injection molding.

A mixed powder of a coarse powder and a fine powder was used as the soft magnetic powder. A powder of an Fe—Si alloy having a D50 particle size of 80 μm and containing Si in an amount of 6.5 mass %, with the remainder having a composition including Fe and unavoidable impurities, was used as the coarse powder. On the other hand, a powder of pure iron having a D50 particle size of 3 μm and containing Fe in an amount of 99.5 mass % or more was used as the fine powder. D50 refers to a particle size value at which, in a volume-based particle size distribution when measured using a laser diffraction type particle size distribution measurement device, the cumulative volume of particles from the small particle size side reaches 50%. On the other hand, a polyamide resin (nylon 9T) was used as the resin. The soft magnetic powder and resin were mixed, the soft magnetic powder was kneaded with the resin in a molten state, and thus a mixture was produced. The coarse powder content (vol %) with respect to the soft magnetic powder as a whole, the fine powder content (vol %) with respect to the soft magnetic powder as a whole, and the soft magnetic powder content (vol %) in the mixture were set at the values shown in Table 1.

A shaping mold having a predetermined shape was prepared, and the above-described mixture was filled into the shaping mold and solidified through cooling to produce a composite material. Here, for each sample, two types of test pieces, a ring-shaped composite material serving as a test piece for measurement of magnetic properties and a plate-shaped composite material for measurement of strength were produced. The size of the ring-shaped composite material was set as follows: outer diameter: 34 mm, inner diameter: 20 mm, and thickness: 5 mm. The size of the plate-shaped composite material was set as follows: length: 77 mm, width: 13 mm, and thickness: 3.2 mm.

Sample No. 1-4

Two types of test pieces, a ring-shaped composite material having the same size as Sample No. 1-1 and a plate-shaped composite material having the same size as Sample No. 1-1 were produced in the same manner as Sample No. 1-1, except that a fine powder having a $D_{50}$ particle size of 35 μm was used.

Sample No. 1-5

Two types of test pieces, a ring-shaped composite material having the same size as Sample No. 1-1 and a plate-shaped composite material having the same size as Sample No. 1-1 were produced in the same manner as Sample No. 1-1, except that the soft magnetic powder did not contain the above-described fine powder, and the above-described coarse powder was used as the soft magnetic powder.

Measurement of Various Average Particle Sizes•Content

A cross section of the composite material of each of the produced samples was observed under a SEM to obtain parameters (1) to (3) below. Measurement of the parameters (1) to (3) was performed in the same manner as in the measurement methods described in the section "Measurement of Various Parameters" above. Table 1 shows the results regarding the parameters (1) and (3).

(1) Soft magnetic powder content with respect to the composite material as a whole (2) Average particle size of coarse powder and average particle size of fine powder (3) Coarse powder content with respect to the soft magnetic powder as a whole and fine powder content with respect to the soft magnetic powder as a whole

TABLE 1

| | Raw material Content | | | Composite material Content | | |
|---|---|---|---|---|---|---|
| Sample No. | Coarse powder (vol %) | Fine powder (vol %) | Soft magnetic powder (vol %) | Coarse powder (vol %) | Fine powder (vol %) | Soft magnetic powder (vol %) |
| 1-1 | 90 | 10 | 70 | 91 | 9 | 69 |
| 1-2 | 80 | 20 | 70 | 79 | 21 | 69 |
| 1-3 | 70 | 30 | 70 | 72 | 28 | 68 |
| 1-4 | 80 | 20 | 70 | 79 | 21 | 70 |
| 1-5 | 100 | 0 | 70 | 100 | 0 | 70 |

As shown in Table 1, it was found that the above-described parameters (1) and (3) of the obtained composite materials were respectively within ranges of ±5% of the soft magnetic powder content with respect to the mixture as a whole and the coarse powder content and the fine powder content with respect to the soft magnetic powder, of the raw material. Also, although not shown in Table 1, it was found that the above-described parameters (2) of each of the obtained composite materials were respectively within ranges of ±5% of the average particle sizes of the coarse powder and the fine powder of the raw material.

Measurement of Magnetic Properties

Saturation magnetization, relative permeability, and iron loss were measured as magnetic properties of the composite materials of the samples. With regard to the saturation magnetization, a magnetic field of 10000 (Oe) (=795.8 kA/m) was applied to the ring-shaped test piece by an electromagnet, and the saturation magnetization of the test piece when sufficiently magnetically saturated was measured. The relative permeability was measured in the following manner. First, 300 turns of wire on the primary side and 20 turns of wire on the secondary side were wound around the ring-shaped test piece to form windings thereon. Then, a B-H initial magnetization curve within a range of H=0 (Oe) to 250 (Oe) was measured. A maximum permeability obtained from this B-H initial magnetization curve was used as the relative permeability μ. It should be noted that a magnetization curve as used herein refers to a so-called direct current magnetization curve. The iron loss was measured in the following manner using the ring-shaped test piece. The iron loss W1/20 k (kW/m$^3$) at an excitation magnetic flux density Bm: 1 kG (=0.1 T) and a measuring frequency: 20 kHz was measured using an AC-BH curve tracer. Table 2 collectively shows the results.

Strength

As the strength of the composite material of each sample, the flexural strength of the produced plate-shaped test piece was measured. Here, a precision universal tester (Autograph AGS-H manufactured by Shimadzu Corporation) was used, and the flexural strength was obtained by conducting a three point flexural test on the plate-shaped test piece. The distance between support points was set at 50 mm, and the test speed was set at 5 mm/min. Table 2 shows the results.

TABLE 2

| | Composite material | | | |
|---|---|---|---|---|
| | Magnetic properties | | | |
| Sample No. | Saturation magnetization (T) | Relative permeability μ | Iron loss W1/20k (kW/m$^3$) | Strength Flexural stress (MPa) |
| 1-1 | 1.23 | 22 | 361 | 101 |
| 1-2 | 1.25 | 23 | 355 | 119 |
| 1-3 | 1.26 | 20 | 362 | 123 |
| 1-4 | 1.25 | 26 | 741 | 81 |
| 1-5 | 1.22 | 24 | 370 | 80 |

As shown in Table 2, Sample Nos. 1-1 to 1-3, in each of which the soft magnetic powder including the two types of powders, the coarse and the fine powders having respective specific sizes, was contained in a specific amount with respect to the composite material as a whole, had extremely low iron loss and high flexural strength as compared with Sample No. 1-4, in which, even though the two types of powders, the coarse and the fine powders, were contained, the D50 of the fine powder was large. Also, Sample Nos. 1-1 to 1-3 had high saturation magnetization, low iron loss, and high flexural strength as compared with Sample No. 1-5, in which the soft magnetic powder did not include a fine powder but rather included only the coarse powder. Sample Nos. 1-1 to 1-3 had a saturation magnetization of 1.23 T or more, and among these, Sample Nos. 1-2 and 1-3 had a saturation magnetization of 1.25 T or more. Sample Nos. 1-1 to 1-3 had an iron loss of less than 365 kW/m$^3$, and among these, Sample No. 1-2 had an iron loss of not more than (less than) 360 kW/m$^3$. Sample Nos. 1-1 to 1-3 had a flexural stress of not less than 100 MPa, among these, Sample Nos. 1-2 and 1-3 had a flexural stress of not less than 110 MPa, and in particular Sample No. 1-3 had a flexural stress of not less than 120 MPa. From these results, it was found that a composite material in which a soft magnetic powder including two types of powders, coarse and fine powders having respective specific sizes, is contained in a specific amount with respect to the composite material as a whole has low iron loss, high saturation magnetization, and high strength.

Figure 2:
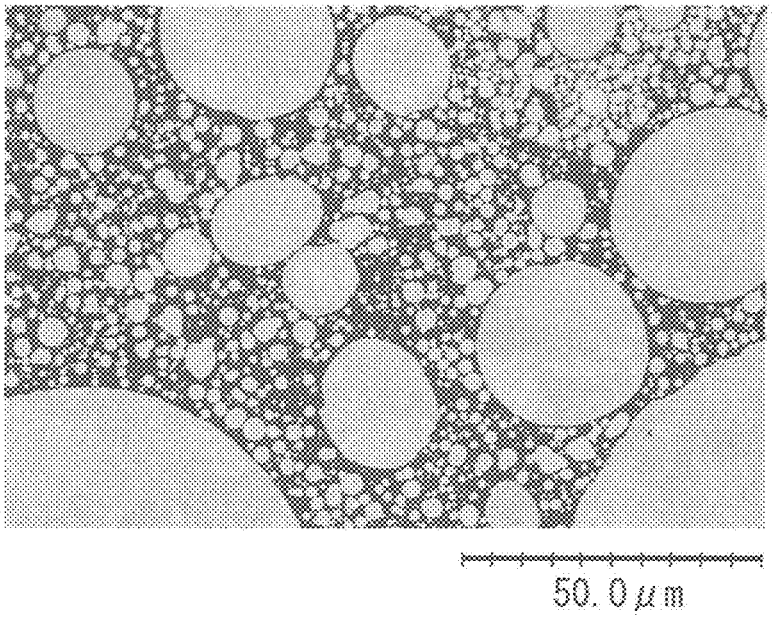
FIG. 2 is a micrograph of Sample No. 1-3.
Figure 3:
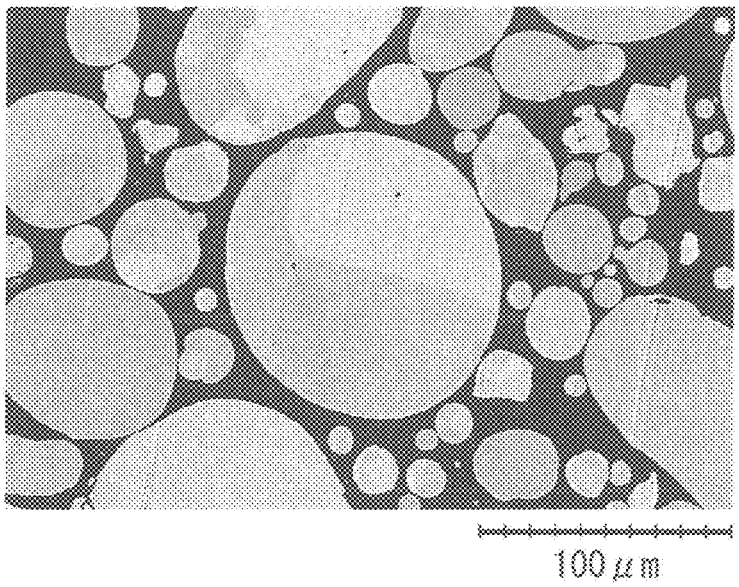
FIG. 3 is a micrograph of Sample No. 1-4.
Figure 4:
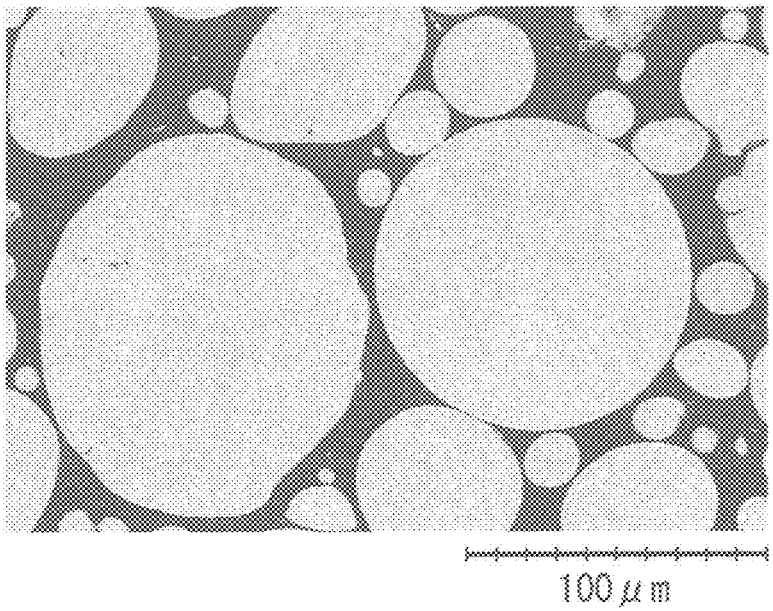
FIG. 4 is a micrograph of Sample No. 1-5.

FIGS. 1 to 4 show micrographs of respective Sample Nos. 1-2 to 1-5 captured by a SEM. In each micrograph, the soft magnetic particles are shown in grey, and the resin is shown in black. With regard to Sample No. 1-2, as shown in FIG. 1, it can be seen that the fine powder is substantially uniformly dispersed between the coarse powder particles, bringing the coarse powder particles into a non-contact state. With regard to Sample No. 1-3, as shown in FIG. 2, it can be seen that even though the fine powder is dispersed between the coarse powder particles, bringing the coarse powder particles into a non-contact state, the fine powder is partially aggregated as shown on the upper-right side in the micrograph. Nevertheless, the saturation magnetization, the iron loss, and the strength are excellent as described above, and in view of this, it can be understood that compared with the rate of degradation of performance due to the partial aggregation, the rate of enhancement of performance as a result of containing the two types of powders, the coarse and the fine powders having respective specific sizes, is extremely high. With regard to Sample No. 1-4, as shown in FIG. 3, it can be seen that even though there are portions in which the fine powder is dispersed between the coarse powder particles to some extent, portions in which only the resin is present between the coarse powder particles extend over certain ranges. With regard to Sample No. 1-5, as shown in FIG. 4, it is recognized that portions in which only the resin is present between the coarse powder particles extend over wide ranges.

In addition, an attempt was made to produce a test piece in the same manner as Sample No. 1-1 except that the coarse powder content (vol %) with respect to the soft magnetic powder as a whole was set at 60 vol %, the fine powder content (vol %) with respect to the soft magnetic powder as a whole was set at 40 vol %, and the soft magnetic powder content in the mixture was set at 70 vol %. However, injection molding was not able to be performed due to insufficient fluidity of the mixture, and thus the test piece was not able to be produced.

Magnetic Component

The above-described composite material can be preferably used for a magnetic core of a magnetic component or a material thereof. The magnetic component includes a coil formed by winding a wire and the magnetic core on which this coil is disposed. Specific examples of the magnetic component include reactors, choke coils, transformers, and motors. By way of example, a reactor 1 will be described with reference to FIGS. 5 and 6, and a choke coil 100 will be described with reference to FIG. 7.

Reactor

The reactor 1 includes a coil 2 having a pair of winding portions 2*a* and 2*b*, and a magnetic core 3 that is combined with the coil 2.

Coil

The pair of winding portions 2*a* and 2*b* are formed by helically winding a single continuous wire 2*w* having no joint portion, and are connected to each other by a connecting portion 2*r*. A coated rectangular wire can be used as the wire 2*w*, the coated rectangular wire being constituted by a rectangular wire or a round wire made of a conductive material, such as copper, aluminum, or an alloy thereof, and an insulating coating made of enamel (typically, polyamideimide) or the like and provided on an outer circumference of the rectangular or round wire. The winding portions 2*a* and 2*b* are each formed as an edgewise coil. The connecting portion 2*r* is formed by bending a portion of the wire on one end side of the coil 2 into a U-shape. Both end portions 2*e* of the winding portions 2*a* and 2*b* are drawn out from respective turn-forming portions, and an external device (not shown) such as a power supply that supplies power to the coil 2 is connected thereto via terminal members (not shown).

Magnetic Core

Figure 5:
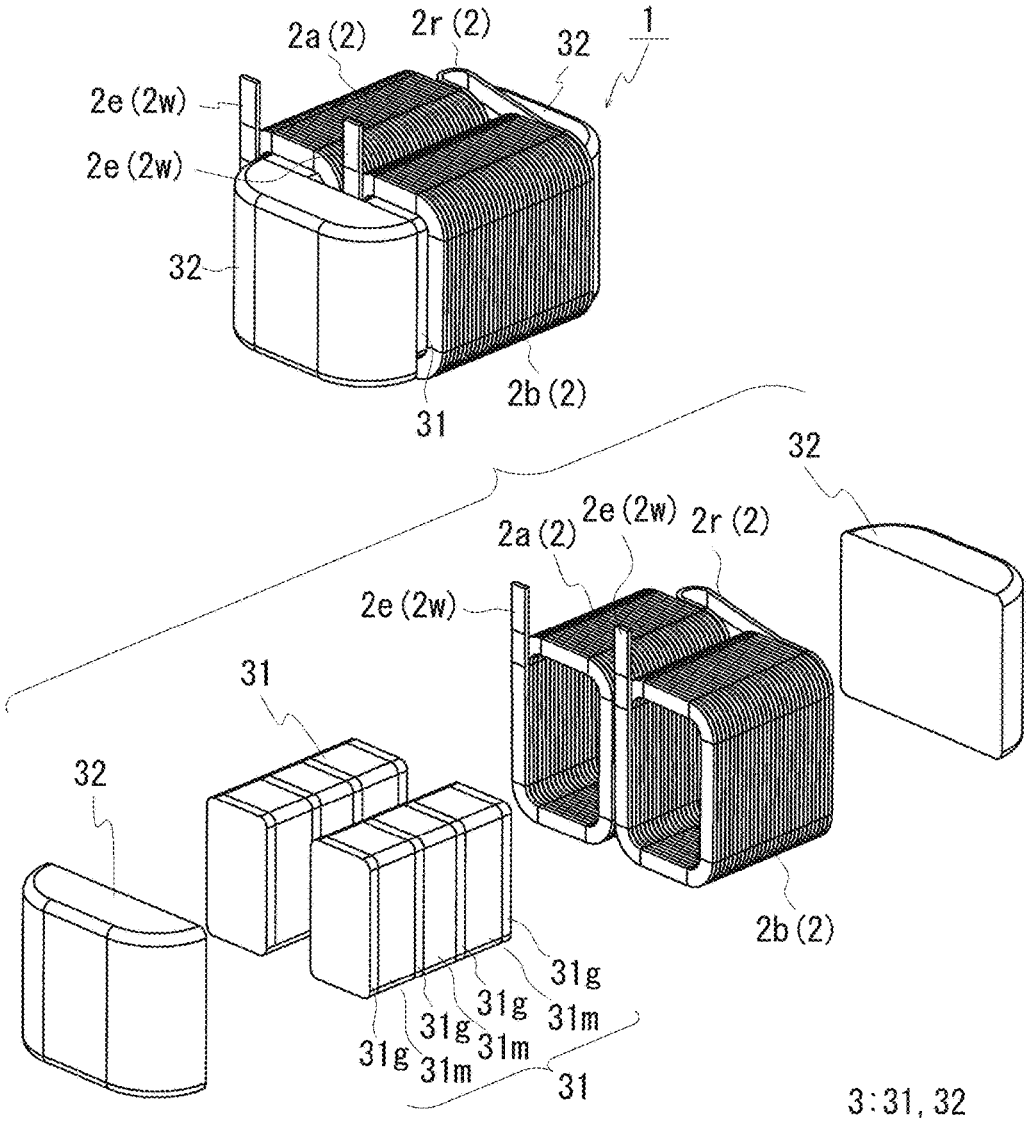
FIG. 5 shows a reactor according to an embodiment of the invention in a schematic perspective view at the top and an exploded perspective view at the bottom.

As shown at the bottom in FIG. 5, the magnetic core 3 includes a pair of inner core portions 31, 31 that are disposed inside the respective winding portions 2*a* and 2*b* and a pair of outer core portions 32, 32 on which the winding portions 2*a* and 2*b* are not disposed and which protrude (are exposed) from the winding portions 2*a* and 2*b*. These core portions are combined together into an annular shape, and thus form a closed magnetic circuit when the coil 2 is excited. The wording "inner core portions that are disposed inside the coil" means inner core portions that are at least partially disposed inside the coil.

Figure 6:
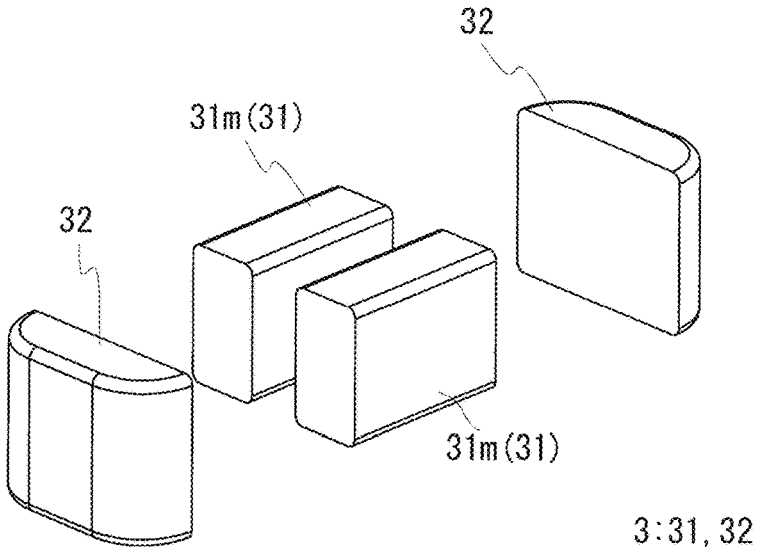
FIG. 6 is an exploded perspective view showing a core included in the reactor according to the embodiment.

The inner core portions 31, 31 each have a substantially rectangular parallelepiped shape. As shown at the bottom in FIG. 5, the inner core portions 31, 31 may each be a stacked body in which a plurality of core pieces 31*m* and gap materials 31*g* having a lower relative permeability than the core pieces 31*m* are alternately stacked on each other. Alternatively, as shown in FIG. 6, the inner core portions 31, 31 may each be constituted by a single, integrated core piece 31*m* with no gap material disposed therein. The outer core portions 32, 32 are each a column-shaped core piece having substantially dome-shaped upper and lower surfaces. At least one of these core pieces is composed of the above-described composite material. Here, all of the core pieces 31*m* of the inner core portions 31 and the core pieces of the outer core portions 32 are composed of the above-described composite material.

Magnetic Properties

The magnetic core 3 may have partially different magnetic properties or may have entirely uniform magnetic properties. In the case where the entire magnetic core 3 is composed of the above-described composite material, the magnetic properties of each core portion can be easily adjusted by adjusting the material and content of the soft magnetic powder of the composite material, the presence or absence of the filler, and the like within the above-described ranges. The composite material may have, for example, the following magnetic properties: a saturation magnetic flux density of 0.6 T or more, and furthermore 1.0 T or more, and a relative permeability of not less than 5 nor more than 50, and preferably not less than 10 nor more than 35. The relative permeability of the entire magnetic core 3 (when the magnetic core 3 includes a gap material, overall relative permeability of the magnetic core 3 including the gap material) is preferably not less than 5 nor more than 50.

Insulating Member

The reactor 1 may also include an insulating member (not shown) that insulates the coil 2 and the magnetic core 3 from each other. For example, covering with insulating tape—insulating paper—insulating sheet, coating (injection molding or the like) with an insulating resin, painting with an insulating material, a bobbin (separately produced) that is to be assembled to the coil 2 or the magnetic core 3, and the like may be adopted as the insulating member.

Effects

The above-described reactor 1 has low loss, high saturation magnetization, and excellent strength, and is thus highly reliable, because the magnetic core 3 is composed of the above-described composite material.

Choke Coil

Figure 7:
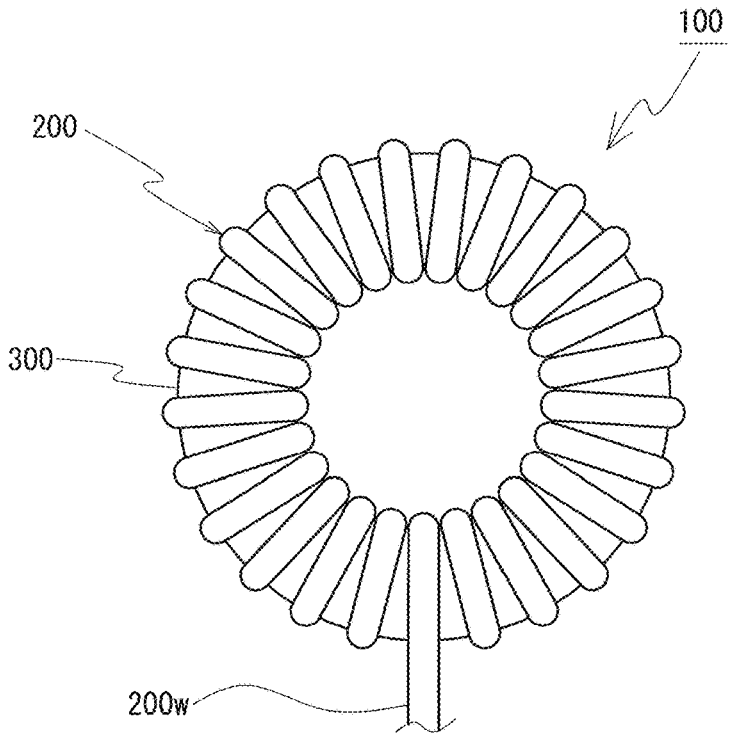
FIG. 7 is a plan view of a choke coil according to an embodiment of the invention.

The choke coil 100 shown in FIG. 7 includes an annular magnetic core 300 (core) and a coil 200 formed by winding a wire 200*w* around an outer circumference of the magnetic core 300. As in the case of the wire 2*w* of the above-described reactor 1, a wire constituted by a conductor and an insulating layer provided on an outer circumference of the conductor may be used as the wire 200*w*. Here, a round wire is used as the conductor. The magnetic core 300 includes the above-described composite material. The entire magnetic core 300 may be composed of the above-described composite material, or the magnetic core 300 may be composed of a combination of the above-described composite material and a core member made of another material, such as dust core or an stacked electrical steel. A core having a gap material having a lower permeability than these composite material and core member and, in particular, made of a non-magnetic material or an air gap, can also be used as the magnetic core 300. The choke coil 100 has low loss, high saturation magnetization, and excellent strength, and is thus highly reliable, because the magnetic core 300 is composed of the above-described composite material.

Converter•Power Conversion Device

The above-described reactor can be applied to uses where the energization conditions are, for example, maximum current (direct current): about 100 A to 1000 A, average voltage: about 100 V to 1000 V, and working frequency: about 5 kHz to 100 kHz, and typically for a constituent component of a converter that is to be installed in a vehicle, such as an electric automobile or a hybrid automobile, or the like or a constituent component of a power conversion device provided with this converter.

Figure 8:
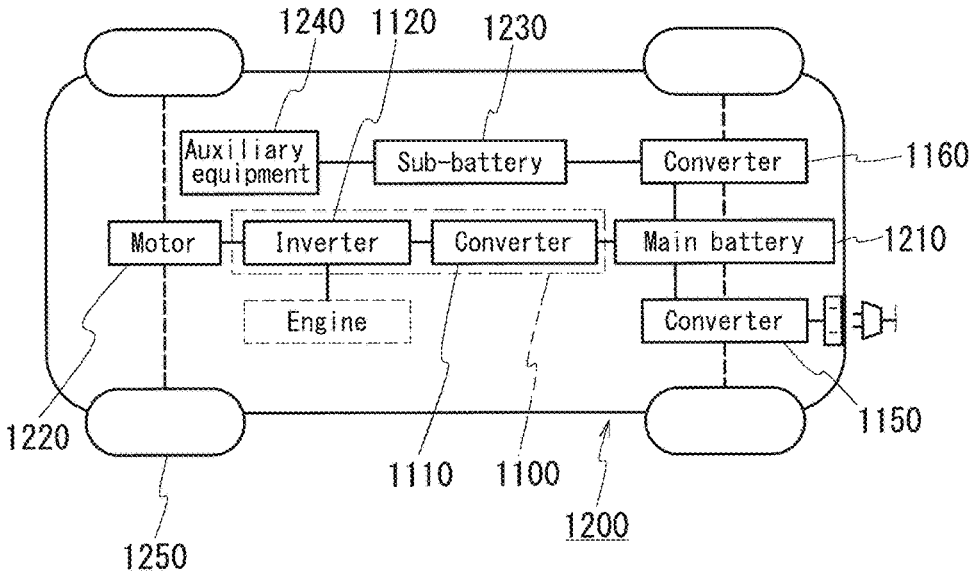
FIG. 8 is a schematic configuration diagram schematically showing a power supply system of a hybrid automobile.

A vehicle 1200 such as a hybrid automobile or an electric automobile includes, as shown in FIG. 8, a main battery 1210, a power conversion device 1100 connected to the main battery 1210, and a motor (load) 1220 that is driven by power supplied from the main battery 1210 and that is used for travelling. The motor 1220, which may typically be a three-phase alternating current motor, drives wheels 1250 during travelling, and functions as a generator during regeneration. In the case of a hybrid automobile, the vehicle 1200 includes an engine in addition to the motor 1220. Although FIG. 8 shows an inlet as a portion for charging the vehicle 1200, a configuration in which a plug is provided may also be adopted.

The power conversion device 1100 has a converter 1110 that is connected to the main battery 1210 and an inverter 1120 that is connected to the converter 1110 and that converts direct current to alternating current and vice versa. While the vehicle 1200 is travelling, the converter 1110 of this example increases the direct current voltage (input voltage), about 200 V to 300 V, of the main battery 1210 to about 400 V to 700 V, thereby feeding power to the inverter 1120. During regeneration, the converter 1110 decreases the direct current voltage (input voltage) output from the motor 1220 via the inverter 1120 to a direct current voltage suitable for the main battery 1210, thereby charging the main battery 1210. While the vehicle 1200 is travelling, the inverter 1120 converts a direct current whose voltage has been increased by the converter 1110 to a predetermined alternating current, thereby feeding power to the motor 1220, and during regeneration, the inverter 1120 converts an alternating current output from the motor 1220 to a direct current and outputs the direct current to the converter 1110.

Figure 9:
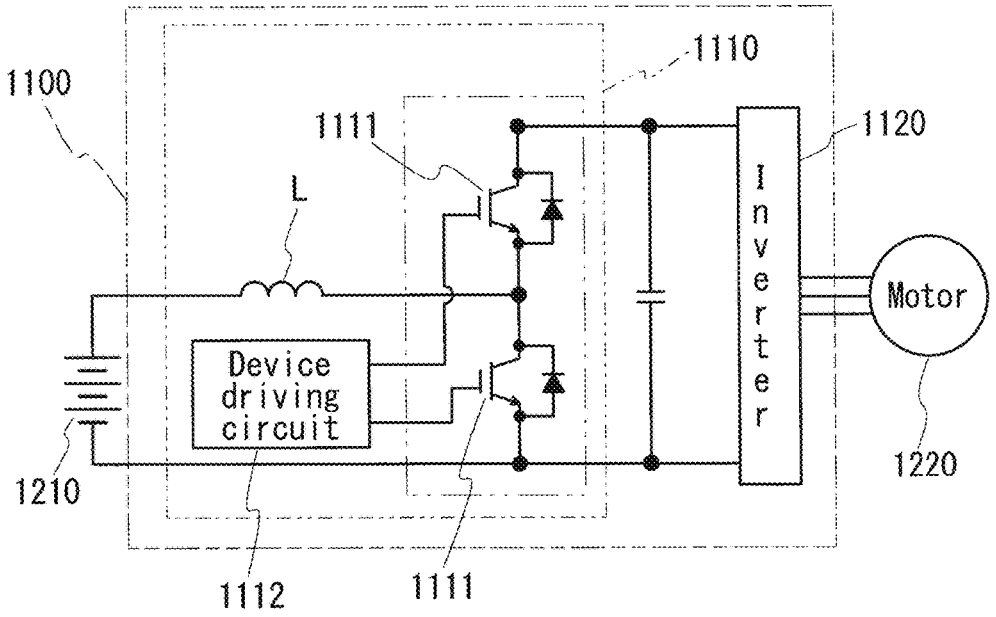
FIG. 9 is a schematic circuit diagram illustrating an example of a power conversion device including a converter.

The converter 1110 includes, as shown in FIG. 9, a plurality of switching elements 1111, a driving circuit 1112 that controls the operation of the switching elements 1111, and a reactor L, and converts an input voltage (here, increases and decreases the voltage) by repeatedly turning ON/OFF (switching operation). A power device such as a field-effect transistor (FET) or an insulated gate bipolar transistor (IGBT) may be used as the switching elements 1111. The reactor L utilizes the property of the coil inhibiting a change in current that is attempting to flow through the circuit, and has the function of smoothing any change in current when current is about to increase or decrease due to the switching operation. The reactor according to the above-described embodiment is provided as this reactor L. Enhancement of the magnetic properties and enhancement of the reliability of the power conversion device 1100 and the converter 1110 can be expected by providing the reactor having low loss, high saturation magnetization, and high strength.

The vehicle 1200 includes, in addition to the converter 1110, a converter 1150 for a power feeding device, the converter 1150 being connected to the main battery 1210, and a converter 1160 for an auxiliary equipment power supply, the converter 1160 being connected to a sub-battery 1230, which serves as a power source for auxiliary equipment 1240, and the main battery 1210 and converting a high voltage of the main battery 1210 to a low voltage. The converter 1110 typically performs DC-DC conversion, whereas the converter 1150 for the power feeding device and the converter 1160 for the auxiliary equipment power supply perform AC-DC conversion. There also are converters 1150 for the power feeding device that perform DC-DC conversion. A reactor having the same configuration as the reactor according to the above-described embodiment or the like, with the size, shape, and the like of the reactor being changed as appropriate, can be used as reactors for the converter 1150 for the power feeding device and the converter 1160 for the auxiliary equipment power supply. Moreover, the above-described reactor or the like can also be used for a converter that converts the input power and only increases or only decreases the voltage.

As described at the beginning of the section titled Details of Embodiments, the present invention is not limited to these examples. For example, a configuration can be adopted in which the above-described reactor includes only a single winding portion.

INDUSTRIAL APPLICABILITY

The composite material according to the present invention can be preferably used for a magnetic core of various types of magnetic components (reactors, choke coils, transformers, motors, and the like) and a material thereof. The magnetic component according to the present invention can be preferably used as a reactor, a choke coil, a transformer, a motor, or the like. The reactor according to the present invention can be preferably used for a constituent component of various types of converters, such as in-vehicle converters (typically, DC-DC converters) to be installed in vehicles such as hybrid automobiles, plug-in hybrid automobiles, electric automobiles, and fuel-cell electric automobiles and converters for air conditioners, as well as power conversion devices.

The invention claimed is:

1. A composite material comprising a soft magnetic powder and a resin having the soft magnetic powder dispersed therein, the soft magnetic powder comprising:

a coarse powder of an Fe-base alloy having an average particle size $D_1$ of not less than 50 μm nor more than 500 μm; and a fine powder of Fe having an average particle size $D_2$ of not less than 0.1 μm nor more than 10 μm, wherein the soft magnetic powder is contained in an amount of not less than 60 vol % nor more than 80 vol % with respect to the composite material as a whole.

2. The composite material according to claim 1, wherein the fine powder is contained in an amount of not less than 5 vol % but less than 40 vol % with respect to the soft magnetic powder as a whole.

3. The composite material according to claim 1, wherein the coarse powder is contained in an amount of more than 60 vol % but not more than 95 vol % with respect to the soft magnetic powder as a whole.

4. The composite material according to claim 1, wherein the soft magnetic powder has a plurality of peaks in its particle size distribution, and at least two peaks of the peaks are peaks of the coarse powder and the fine powder.

5. The composite material according to claim 1 wherein a ratio $D_2/D_1$ of the average particle size $D_2$ of the fine powder to the average particle size $D_1$ of the coarse powder is not more than ⅓.

6. The composite material according to claim 1, wherein the resin is a thermoplastic resin.

7. A magnetic component comprising a coil formed by winding a wire and a magnetic core on which the coil is disposed, wherein at least a portion of the magnetic core is composed of the composite material according to claim 1.

8. A reactor comprising a coil formed by winding a wire and a magnetic core on which the coil is disposed, wherein at least a portion of the magnetic core is composed of the composite material according to claim 1.

9. The composite material according to claim 2, wherein the coarse powder is contained in an amount of more than 60 vol % but not more than 95 vol % with respect to the soft magnetic powder as a whole.

10. The composite material according to claim 2, wherein the soft magnetic powder has a plurality of peaks in its particle size distribution, and at least two peaks of the peaks are peaks of the coarse powder and the fine powder.

11. The composite material according to claim 3, wherein the soft magnetic powder has a plurality of peaks in its particle size distribution, and at least two peaks of the peaks are peaks of the coarse powder and the fine powder.

12. The composite material according to claim 2, wherein a ratio $D_2/D_1$ of the average particle size $D_2$ of the fine powder to the average particle size $D_1$ of the coarse powder is not more than ⅓.

13. The composite material according to claim 3, wherein a ratio $D_2/D_1$ of the average particle size $D_2$ of the fine powder to the average particle size $D_1$ of the coarse powder is not more than ⅓.

14. The composite material according to claim 4, wherein a ratio $D_2/D_1$ of the average particle size $D_2$ of the fine powder to the average particle size $D_1$ of the coarse powder is not more than ⅓.

15. The composite material according to claim 2, wherein the resin is a thermoplastic resin.

16. The composite material according to claim 3, wherein the resin is a thermoplastic resin.

17. The composite material according to claim 4, wherein the resin is a thermoplastic resin.

18. The composite material according to claim 5, wherein the resin is a thermoplastic resin.

* * * * *